US006171477B1

(12) United States Patent
Morel et al.

(10) Patent No.: US 6,171,477 B1
(45) Date of Patent: Jan. 9, 2001

(54) HYDROCONVERSION OF VACUUM DISTILLATES AND DEASPHALTED OILS IN FIXED BEDS AND BOILING BEDS

(75) Inventors: Frédéric Morel, Francheville; Jean-Luc Duplan, Irigny; Alain Billon, Le Vesinet; Stéphane Kressmann, Serezin du Rhone, all of (FR)

(73) Assignee: Institut Francais du Petrole, Rueil-Malmaison Cedex (FR)

( * ) Notice: Under 35 U.S.C. 154(b), the term of this patent shall be extended for 0 days.

(21) Appl. No.: 09/093,808

(22) Filed: Jun. 9, 1998

(30) Foreign Application Priority Data

Jun. 10, 1997 (FR) ..... 97 07272

(51) Int. Cl.[7] ..... C10G 65/00; C10G 69/04; C10G 1/08; C10G 45/14

(52) U.S. Cl. ..... 208/210; 208/213; 208/60; 208/58; 208/86; 208/89

(58) Field of Search ..... 208/86, 89, 61, 208/58, 210, 213

(56) References Cited

U.S. PATENT DOCUMENTS

| | | | | |
|---|---|---|---|---|
| 3,278,415 | * | 10/1966 | Doberenz et al. | 208/45 |
| 3,686,093 | | 8/1972 | Irvine et al. | 208/57 |
| 3,725,251 | | 4/1973 | Alpert et al. | 208/210 |
| 3,891,538 | * | 6/1975 | Walkey | 208/50 |
| 4,602,000 | * | 7/1986 | Dupin et al. | 502/335 |
| 4,938,862 | * | 7/1990 | Visser et al. | 208/67 |
| 5,384,297 | * | 1/1995 | Prada et al. | 502/66 |
| 5,591,325 | | 1/1997 | Higashi | 208/251 H |
| 5,968,347 | * | 10/1999 | Kolodziej et al. | 208/213 |

* cited by examiner

*Primary Examiner*—Walter D. Griffin
*Assistant Examiner*—Tam M. Nguyen
(74) *Attorney, Agent, or Firm*—Millen White Zelano & Branigan

(57) ABSTRACT

A process for the conversion of a hydrocarbon fraction comprising a step a) for treating a hydrocarbon charge in the presence of hydrogen in at least one reactor containing at least one hydrodesulphurisation catalyst in a fixed bed under conditions that make it possible to obtain a liquid effluent with a reduced sulphur content, a step b) for treating at least a part of the liquid effluent originating from step a) in the presence of hydrogen in at least one three-phase reactor, containing at least one hydrotreatment catalyst in a boiling bed, operating with an ascending stream of liquid and gas, said reactor comprising at least one means of withdrawing the catalyst from said reactor situated near the bottom of the reactor and at least one means of making up fresh catalyst in said reactor situated near the top of said reactor, and a step c) in which at least part of the product obtained in step b) is passed to a distillation zone from which are recovered a gas fraction, a motor fuel fraction of the petrol type, a motor fuel fraction of the diesel type, and a liquid fraction which is heavier than the diesel type fraction. This process may also contain a step d) for the catalytic cracking of the heavy fraction obtained in step c).

17 Claims, No Drawings

HYDROCONVERSION OF VACUUM DISTILLATES AND DEASPHALTED OILS IN FIXED BEDS AND BOILING BEDS

BACKGROUND OF THE INVENTION

The present invention relates to the refining and conversion of the heavy fractions of hydrocarbon distillates containing, inter alia, sulphur impurities. It relates more particularly to a process which allows the conversion, at low pressure, at least in part, of a hydrocarbon charge, for example, a vacuum distillate obtained by direct distillation of a crude petroleum, into good quality petrol and diesel light fractions and into a heavier product which may be used as a charge for catalytic cracking in a conventional catalytic cracking plant in a fluidised bed and/or in a catalytic cracking plant in a fluidised bed comprising a double regeneration system and optionally a cooling system for the catalyst at the regeneration stage. The present invention also relates in one of these aspects to a process for the production of petrol and/or diesel comprising at least one catalytic cracking step in a fluidised bed.

SUMMARY OF THE INVENTION

One of the objects of the present invention is to produce, from a certain particular fraction of hydrocarbons which will be defined in the rest of the description, by partial conversion of said fractions, lighter fractions which are easy to exploit, such as motor fuels: petrol and diesel.

Within the scope of the present invention, the conversion of the charge to lighter fractions is usually between 20 and 75% and most often between 25 and 60% and even limited to about 50%.

The charges which are treated within the scope of the present invention are vacuum distillates of direct distillation, vacuum distillates originating from a conversion process such as, for example, those derived from coking, a hydroconversion in a fixed bed such as those originating from the HYVAHL® processes for the treatment of heavies, developed by the applicant, or processes for the hydrotreatment of heavies in a boiling bed such as those originating from the H-OIL® processes, oils deasphalted with solvent, for example, oils deasphalted with propane, butane or pentane which originate from the deasphalting of a vacuum residuum of direct distillation or of vacuum residua originating from the HYVAHL® or H-OIL® processes. The charges may also be formed by mixing these various fractions in any proportions, particularly deasphalted oil and vacuum distillate. They may also contain light cycle oil (LCO) of various origins, high cycle oil (HCO) of various origins and also diesel cuts originating from catalytic cracking generally having a distillation interval from about 150° C. to about 370° C. They may also contain aromatic extracts obtained within the context of the production of lubricating oils.

The object of the present invention is to obtain a product with a low sulphur content particularly under conditions of relatively low pressure so as to limit the cost of the investment required. This process makes it possible to obtain a petrol type motor fuel containing less than 10 ppm by mass of sulphur, thus complying with the most stringent specifications in terms of sulphur content for this type of fuel, and this from a charge containing more than 3% by mass of sulphur. Another particularly important aspect is that a diesel type motor fuel is obtained having a sulphur content of less than 500 ppm and a residuum whose initial boiling point is, for example, about 370° C., which may be passed as a charge or part of a charge to a conventional catalytic cracking step or to a reactor for the catalytic cracking of residuum, such as a double regeneration reactor, and preferably to a conventional catalytic cracking reactor.

In its broadest form, the present invention is defined as a process for the conversion of a hydrocarbon fraction having a sulphur content of at least 0.5%, often at least 1% and very often at least 2% by weight and an initial boiling point of at least 360° C., often at least 370° C. and most often at least 380° C., and a final boiling point of at least 500° C., often at least 550° C., and which may even be higher than 600° C. or even 700° C., characterised in that it comprises the following steps:

a) the hydrocarbon charge is treated in a treatment section in the presence of hydrogen, said section comprising at least one reactor containing at least one hydrodesulphurisation catalyst in a fixed bed under conditions that make it possible to obtain a liquid effluent with a reduced sulphur content;

b) at least part, and often all, of the hydrodesulphurised liquid effluent originating from step a) is passed to a treatment section in the presence of hydrogen, said section comprising at least one three-phase reactor containing at least one hydrotreatment catalyst in a boiling bed operating with an ascending stream of liquid and gas, said reactor containing at least one means of withdrawing the catalyst from said reactor situated near the bottom of the reactor and at least one means of making up fresh catalyst in said reactor situated near the top of said reactor;

c) at least a part, and often all, of the product obtained in step b) is passed to a distillation zone from which are recovered a gas fraction, a petrol type motor fuel fraction, a diesel type motor fuel fraction and a liquid fraction which is heavier than the diesel type fraction.

According to one variant, the heavier liquid fraction of hydroconverted charge originating from step c) is passed to a catalytic cracking section [stage d)] in which it is treated under conditions that make it possible to produce a gas fraction, a petrol fraction, a diesel fraction and a slurry fraction.

The gas fraction obtained in steps c) or d) usually contains mainly saturated and unsaturated hydrocarbons having 1 to 4 carbon atoms in their molecules (methane, ethane, propane, butanes, ethylene, propylene, butylenes). The petrol type fraction obtained in step c) is passed, for example, at least in part and preferably wholly to the fuel pool. The diesel type fraction obtained in step c) is passed, for example, at least in part and preferably wholly to the fuel pool. According to another embodiment of the invention, at least a part of the diesel type fraction obtained in step c) is returned to step a). The slurry fraction obtained in step d) is passed most often at least in part or even wholly to the heavy fuel pool of the refinery, generally after separation of the fine particles which it contains in suspension. In another embodiment of the invention, this slurry fraction is returned at least in part and even wholly to the entrance of the catalytic cracking unit of step d).

The conditions of step a) for treating the charge in the presence of hydrogen are usually as follows: In the desulphurisation zone, at least one fixed bed of conventional hydrodesulphurisation catalyst is used, and preferably at least one of the catalysts described by the applicant, in particular, at least one of those described in the patents EP-B-113297 and EP-B-113284. Operations are usually carried out at an absolute pressure of 2 to 35 MPa, often 5 to 20 MPa and most often 6 to 10 MPa at a temperature of about 300 to about 500° C. and often about 350° C. to about 450° C. The VVH and the hydrogen partial pressure are important factors which are chosen as a function of the characteristics of the charge to be treated and of the conversion required. Most often, the VVH is situated in a range from about 0.1 to about 5 and preferably about 0.5 to about 2. The amount of hydrogen mixed with the charge is usually about 100 to about 5000 normal cubic meters ($Nm^3$) per cubic meter ($m^3$) of liquid charge and most often about 200 to about 1000 $Nm^3/m^3$ and preferably about 300 to about 500 $Nm^3/m^3$. It is useful to operate in the presence of hydrogen sulphide and the partial pressure of the hydrogen sulphide is usually about 0.002 times to about 0.1 times and preferably about 0.005 times to about 0.05 times the total pressure. In the hydrodesulphurisation zone, the ideal catalyst must have a considerable hydrogenating capacity so as to bring about thorough refining of the products and to obtain a substantial lowering of the sulphur content. It is possible, for example, to use one of the catalysts described by the applicant in the patents EP-B-113297 and EP-B-113284. In the preferred embodiment, the hydrodesulphurisation zone operates at relatively low temperature resulting in thorough hydrogenation and limited coking. It would not be beyond the scope of the present invention to use a single catalyst or several different catalysts simultaneously or successively in the hydrodesulphurisation zone. Usually, this step a) is carried out on an industrial scale in one or more reactors with a descending stream of liquid.

The hydrotreatment step b) converting the product originating from the hydrodesulphurisation step a) is carried out under conventional hydrotreatment conditions in a boiling bed of a liquid hydrocarbon fraction. Operations are usually carried out under an absolute pressure of 2 to 35 MPa, often 5 to 20 MPa and most often 6 to 10 MPa at a temperature of about 300 to about 550° C. and often about 350 to about 500° C. The volume velocity per hour VVH and the hydrogen partial pressure are important factors which are chosen as a function of the characteristics of the product to be treated and of the conversion required. Most often, the VVH is situated in a range from about 0.1 $h^{-1}$ to about 10 $h^{-1}$ and preferably about 0.5 $h^{-1}$ to about 5 $h^{-1}$. The amount of hydrogen mixed with the charge is usually about 50 to 5000 normal cubic meters ($Nm^3$) per cubic meter ($m^3$) of liquid charge and most often about 100 to about 1000 $Nm^3/m^3$ and preferably about 300 to about 500 $Nm^{3/}/m^3$. It is possible to use a conventional granular hydrotreatment catalyst. This catalyst may be a catalyst comprising metals of group VIII, for example, nickel and/or cobalt, most often in association with at least one metal of group VIB, for example, molybdenum. It is possible, for example, to use a catalyst containing 0.5 to 10% by weight of nickel and preferably 1 to 5% by weight of nickel (expressed as nickel oxide NiO) and 1 to 30% by weight of molybdenum, preferably 5 to 20% by weight of molybdenum (expressed as molybdenum oxide $MoO_3$) on a support, for example, an alumina support. This catalyst is most often in the form of an extrudate or beads. The spent catalyst is replaced in part by fresh catalyst by withdrawal at the bottom of the reactor and introduction of fresh or new catalyst at the top of the reactor at a regular interval of time, i.e. for example, batchwise or quasi continuously. It is possible, for example, to introduce fresh catalyst every day. The rate of replacement of the spent catalyst by fresh catalyst may be, for example, about 0.05 kilograms to about 10 kilograms per cubic meter of charge. This withdrawal and this replacement are carried out using devices that permit the continuous operation of this hydrotreatment step. The unit usually comprises a recirculation pump allowing the catalyst to be maintained in the boiling bed by continuous recycling of at least part of the liquid drawn off at the top of the reactor and reinjected at the bottom of the reactor. It is also possible to pass the spent catalyst withdrawn from the reactor to a regeneration zone in which the carbon and the sulphur it contains are removed, and then to return this regenerated catalyst to the converting hydrotreatment step b).

Most often, this hydrotreatment step b) is implemented under the conditions of the T-STAR® process as described, for example, in the article Heavy Oil Hydroprocessing, published by l'Aiche, March 19–23, HOUSTON, Tex., paper number 42d.

The products obtained during this step b) are passed to a separation zone from which a gas fraction and a liquid fraction may be recovered. In this case, this liquid fraction is passed to a second separation zone in which it is split into petrol and diesel light fractions which may be passed at least in part to the fuel pools, and into a heavier fraction. Usually, this heavier fraction has an initial boiling point of about 350 to about 400° C. and preferably about 360 to about 380° C. This heavier fraction may be passed, at least in part, to the heavy fuel pool with a low sulphur content (usually less than 1% by weight) of the refinery.

In the distillation zone in step c), the conditions are generally chosen in such a way that the cutpoint for the heavy charge is about 350 to about 400° C. and preferably about 360 to about 380° C. A petrol fraction of which the final boiling point is most often about 150 and a diesel fraction of which the initial boiling point is usually about 150° C. and the final boiling point is about 370° C. are also recovered in this distillation zone.

Finally, according to the variant mentioned above in a catalytic cracking step d), at least a part of the heavy fraction of the hydrotreated charge obtained in step c) may be passed to a conventional catalytic cracking section in which it is cracked catalytically in a conventional manner under conditions well known to those skilled in the art in order to produce a fuel fraction (containing a petrol fraction and a diesel fraction) which is usually passed at least in part to the fuel pools, and a slurry fraction which will be passed, for example, at least in part or even wholly to the heavy fuel pool or recycled at least in part or even wholly to the catalytic cracking step d). Within the scope of the present invention, the expression conventional catalytic cracking encompasses the cracking processes that comprise at least one regeneration step by partial combustion and those comprising at least one regeneration step by total combustion and/or comprising at the same time at least one partial combustion step and at least one total combustion step. In a particular embodiment of the invention, a part of the diesel fraction obtained during this step d) is recycled either to step a) or to step d) in mixture with the charge introduced into this catalytic cracking step d). In the present description, the term a part of the diesel fraction must be understood as being a fi-action less than 100%. It would not be beyond the scope of the present invention to recycle a part of the diesel fraction to step a), and another part to step d), all of these two parts not necessarily representing the whole of the diesel fraction. It is also possible, within the scope of the present invention, to recycle all the diesel obtained by catalytic cracking either to step a) or to step d), or a fraction in each of these steps, the sum of these fractions representing 100% of the diesel fraction obtained in step d). It is also possible to recycle to step d) at least a part of the petrol fraction obtained in this catalytic cracking step d).

For example, a summary description of catalytic cracking (of which the first industrial use dates back to 1936)

(HOUDRY process) or to 1942 for the use of catalyst in a fluidised bed) can be found in ULLMANS ENCYCLOPEDIA OF INDUSTRIAL CHEMISTRY, volume A 18, 1991, pages 61 to 64. Normally, a conventional catalyst is used comprising a matrix, optionally an additive and at least one zeolite. The quantity of zeolite is variable but usually about 3 to 60% by weight, often about 6 to 50% by weight and most often about 10 to 45% by weight. The zeolite is usually dispersed in the matrix. The quantity of additive is usually about 0 to 30% by weight and often about 0 to 20% by weight. The quantity of matrix represents the remainder to 100% by weight. The additive is generally chosen from the group composed of oxides of metals of group IIA of the periodic classification of the elements such as, for example, magnesium oxide or calcium oxide, the oxides of rare earths and the titanates of metals of group IIA. The matrix is most often a silica, an alumina, a silica-alumina, a silica-magnesia, a clay, or a mixture of two or more of these products. The most commonly used zeolite is zeolite Y. Cracking is carried out in an appreciably vertical reactor either in ascending mode (riser) or descending mode (dropper). The choice of catalyst and of operating conditions depend on the products sought as a function of the charge treated as described, for example, in the article by M. MARCILLY, pages 990–991 published in the review of the Institut Français du Pétrole Nov.–Dec. 1975 pages 969–1006. Operations are usually carried out at a temperature of about 450 to about 600° C. and with residence times in the reactor of less than 1 minute, often about 0.1 to about 50 seconds.

The catalytic cracking step d) may also be a catalytic cracking step in a fluidised bed, for example, according to the process developed by the applicant known as R2R. This step may be carried out in a conventional manner known to those skilled in the art under suitable cracking conditions with a view to producing hydrocarbon products with a lower molecular weight. Descriptions of operation of the catalysts that may be used within the scope of fluidised bed cracking in this step d) are described, for example, in the patent documents U.S. Pat. No. 4,695,370, EP-B-184517, U.S. Pat. No. 4,959,334, EP-B-323297, U.S. Pat. Nos. 4,965,232, 5,120,691, 5,344,554, 5,449,496, EP-A-485259, U.S. Pat. Nos. 5,286,690, 5,324,696 and EP-A-699224 of which the descriptions are regarded as being incorporated in the present description solely by virtue of being mentioned at this juncture.

The catalytic cracking fluidised bed reactor may operate as a riser or dropper. Although not a preferred embodiment of the present invention, it is also conceivable to carry out catalytic cracking in a mobile bed reactor. The particularly preferred catalytic cracking catalysts are those which contain at least one zeolite, usually in mixture with an appropriate matrix such as, for example, alumina, silica, silica-alumina.

According to a particular embodiment, when the charge treated is a vacuum distillate originating from vacuum distillation of a bottoms residuum of atmospheric distillation of a crude petroleum, it is advantageous to recover the vacuum residuum and to pass it to a solvent deasphalting step f) from which are recovered an asphalt fraction and a deasphalted oil which is passed, for example, at least in part, to the desulphurisation step a) in mixture with the vacuum distillate.

The deasphalting step f) with the aid of a solvent is carried out under conventional conditions well known to the man skilled in the art. It is thus possible to refer to the article by BILLON et al., published in 1994 in volume 49 number 5 of the review of the INSTITUT FRANçAIS DU PÉTROLE pages 495 to 507 or to the description given in the description of French patent FR-B-2480773 or in the description of French patent FR-B-2681871 in the name of the applicant, or in the description of the patent U.S. Pat. No. 4,715,946 in the name of the applicant, the descriptions of which are regarded as being incorporated in the present description solely by virtue of being mentioned at this juncture. Deasphalting is usually carried out at a temperature of 60 to 250° C. with at least one hydrocarbon solvent having 3 to 7 carbon atoms, optionally containing at least one additive. The solvents that may be used and the additives are described at length in the documents cited above and in the patent documents U.S. Pat. Nos. 1,948,296, 2,081,473 2,587,643, 2,882,219, 3,278,415 and 3,331,394, for example. It is also possible to carry out solvent recovery according to the opticritical process, i.e. using a solvent under supercritical conditions. In particular, this process makes it possible to improve considerably the overall economy of the process. This deasphalting may be carried out in a mixer-decanter or in an extraction column. Within the scope of the present invention, the technique using at least one extraction column is preferred.

In a preferred form of the invention, the residual asphalt obtained in step f) is passed to a steam-oxygen gasification section in which it is converted to a gas containing hydrogen and carbon monoxide. This gas mixture may be used for the synthesis of methanol or for the synthesis of hydrocarbons by the Fischer-Tropsch reaction. This mixture within the scope of the present invention is preferably passed to a shift conversion section in which, in the presence of steam, it is converted to hydrogen and carbon dioxide. The hydrogen obtained may be used in steps a) and b) of the process according to the invention. The residual asphalt may also be used as a solid fuel or, after fluxing, as a liquid fuel.

EXAMPLE

This example is carried out in a pilot plant which differs from an industrial plant in that the flow of liquids in the hydrodesulphurisation zone is ascending. It has, in fact, been verified elsewhere that this mode of operating in a pilot plant provides results equivalent to those of industrial scale plants operating with a descending stream of liquid.

A heavy vacuum distillate (VD) of Safaniya origin is treated. Its characteristics are shown in Table 1, column 1. All the yields are calculated from a base 100 (by mass) of VD.

This Safaniya vacuum distillate is treated in a catalytic hydrodesulphurisation section. The plant used is a pilot plant comprising two reactors in series, the first operating as a riser with a catalyst in a fixed bed and the second containing a boiling bed of converting hydrotreatment catalyst. The first reactor simulates the operation of a reactor of an industrial scale plant for the hydrodesulphurisation of vacuum distillate in a fixed bed, whereas the second reactor simulates a reactor of an industrial scale plant using the T-STAR® process in a boiling bed. The flow of liquids is upwards in each of the reactors.

One liter of catalyst HR 348 produced and sold by Procatalyse is charged to each of the reactors.

The operating conditions used are as follows:

overall VVH =0.5 $h^{-1}$

P=75 bar

Hydrogen recycling=400 l $H_2$/l of charge

Temperature of first reactor=380° C.

Temperature of second reactor=425° C.

The liquid products originating from the second reactor are fractionated in the laboratory into a petrol fraction with a final distillation point equal to 150° C., a diesel fraction with an initial boiling point of 150° C. and a final distillation point of 370° C., and into a heavier fraction with an initial distillation point of 370° C.

The liquid fraction heavier than the diesel type fraction is pre-heated to 150° C. then brought into contact at the bottom of a vertical pilot reactor with a hot regenerated catalyst originating from a pilot regenerator. The inlet temperature of the catalyst in the reactor is 683° C. The ratio of the catalyst flow to the flow of charge is 6.61. The heat supplied by the catalyst at 683° C. allows the vaporisation of the charge and the cracking reaction which is endothermic. The average residence time of the catalyst in the reaction zone is about 3 seconds. The operating pressure is 2 bars absolute. The temperature of the catalyst measured at the outlet of the fluidised bed riser reactor is 505° C. The cracked hydrocarbons and the catalyst are separated by means of cyclones situated in a stripping zone where the catalyst is stripped. The catalyst which was coked during the reaction and stripped in the stripping zone is then passed to the regenerator. The coke content of the solid (delta coke) at the inlet of the regenerator is 0.83%. This coke is burnt by the air injected into the regenerator. The highly exothermic combustion raises the temperature of the solid from 505° C. to 683° C. The hot regenerated catalyst leaves the regenerator and is returned to the bottom of the reactor.

The hydrocarbons separated from the catalyst leave the stripping zone; they are cooled by heat exchangers and passed to a stabilisation column which separates the gases and liquids. The liquid (C5+) is also sampled then fractionated in another column in order to recover a petrol fraction, a diesel fraction and a heavy fuel fraction or slurry (360° C. +).

Tables 2 and 3 give the petrol and diesel yields and the main characteristics of these products obtained from the process as a whole. Table 4 gives the main characteristics of the heavy product (after hydrodesulphurisation and conversion in the boiling bed reactor) at the outlet of the fractionating column.

TABLE NO. 1

Characteristics of the charge

| Cut | 1 VD |
|---|---|
| | Safaniya |
| Yield/VVH mass % | 100 |
| Density 15/4 | 0.940 |
| Sulphur, mass % | 3.08 |
| Carb. Conradson, mass % | 1.2 |
| Nitrogen, ppm mass | 1092 |
| Hydrogen, mass % | 11.9 |
| ASTM D 1160 in ° C. | |
| 5% point | 366 |
| 95% point | 578 |

TABLE NO. 2

Balance and characteristics of the petrol produced

| | Petrol Pl-150 ° C. ex HDS + T-STAR | Petrol Pl-220 ° C. ex FCC | Petrol Pl-220 ° C. total |
|---|---|---|---|
| Yield/charge mass % | 9.3 | 27.9 | 37.2 |
| Density 15/4 | 0.74 | 0.736 | 0.737 |
| Sulphur in ppm, mass | 50 | 40 | 42 |
| Octane (RON + MON)/2 | 55 | 86 | 78 |

TABLE NO. 3

Balance and characteristics of the diesel produced

| | Diesel 150–370° C. ex HDS + T STAR | Diesel 220–360° C. ex FCC | Diesel 150–370° C. total |
|---|---|---|---|
| Yield/charge mass % | 36.4 | 4.4 | 40.8 |
| Density 15/4 | 0.855 | 0.924 | 0.862 |
| Sulphur, ppm, mass | 330 | 1870 | 497 |
| Cetane | 45 | 28 | 43 |

TABLE NO. 4

Balance and characteristics of the heavy fraction

| | Heavy fraction 370° C. + ex HDS + T STAR |
|---|---|
| Yield/charge mass % | 45.2 |
| Density 15/4 | 0.865 |
| Sulphur. ppm mass | 1200 |
| Hydrogen, mass % | 13.1 |

What is claimed is:

1. A process for the conversion of a hydrocarbon fraction having a sulphur content of at least 0.5% by weight, an initial boiling point of at least 360° C. and a final boiling point of at least 500° C., to a petrol fraction containing less than 10 ppm sulphur and a diesel fraction containing less than 500 ppm sulphur, comprising the following steps:

a) the hydrocarbon fraction is treated in a treatment section in the presence of hydrogen, said section comprising at least one reactor containing at least one hydrodesulphurisation catalyst in a fixed bed under hydrodesulphurizing conditions;

b) at least part of the hydrodesulphurised liquid effluent originating from step a) is passed to a hydrotreatment section in the presence of hydrogen, said section comprising at least one three-phase reactor containing at least one hydrotreatment catalyst under hydrotreatment conditions in a boiling bed operating with an ascending stream of liquid and gas, said reactor containing at least one means of withdrawing the catalyst from said reactor situated near the bottom of the reactor and at least one means of making up fresh catalyst in said reactor situated near the top of said reactor, c) at least a part of the product obtained in step b) is passed to a distillation zone from which are recovered a gas fraction, a petrol fraction, a diesel fraction and a liquid fraction which is heavier than the diesel fraction; and d) a part of the heavier liquid fraction obtained in step c) is passed to a catalytic cracking section for treatment under catalytic cracking conditions that produce a gas fraction, a petrol fraction, a diesel fraction and a slurry fraction.

2. A process according to claim 1 in which, during step a), the treatment in the presence of hydrogen is carried out under an absolute pressure of 2 to 35 MPa, at a temperature of about 300 to 500° C. with a volumetric velocity per hour of about 0.1 to 5 $h^{-1}$.

3. A process according to claim 1 in which at least part of the diesel fraction recovered in catalytic cracking step d) is returned to step a).

4. A process according to claim 1, in which the converting hydrotreatment step b) is carried out under an absolute pressure of about 2 to 35 MPa, at a temperature of about 300 to 550° C. with a volumetric velocity per hour of about 0.1 to 10 $h^{-1}$ and the amount of hydrogen mixed with the charge is about 50 to 5000 $Nm^3/m^3$.

5. A process according to claim 1 in which catalytic cracking step d) is carried out under conditions that make it possible to produce a petrol fraction which is passed at least in part to the fuel pool, a diesel fraction which is passed at least in part to the diesel pool and a slurry fraction which is passed at least in part to the heavy fuel pool.

6. A process according to claim 1, in which at least a part of the diesel fraction and/or the petrol fraction obtained in catalytic cracking step d) is recycled to the inlet of this step d).

7. A process according to claim 1, in which at least a part of the slurry fraction obtained in catalytic cracking step d) is recycled to the inlet of this step d).

8. A process according to claim 1, in which the hydrocarbon fraction treated in step a) is a vacuum distillate originating from the vacuum distillation of a bottoms residuum of atmospheric distillation of a crude petroleum, and the vacuum residuum from said vacuum distillation is passed to a deasphalting step f) from which are recovered a deasphalted oil which is passed at least in part in admixture with said vacuum distillate to dehydrosulphurisation step a), and asphalt.

9. A process according to claim 8, in which deasphalting is carried out at a temperature of 60 to 250° C. with at least one hydrocarbon solvent having 3 to 7 carbon atoms.

10. A process according to claim 1 in which at least a part of the heavier liquid fraction of hydrotreated charge obtained in step c) is passed to the heavy fuel pool.

11. A process according to claim 1, in which the petrol fraction and the diesel fraction obtained in step c) are passed at least in part to their respective fuel pools.

12. A process according to claim 1, in which the diesel fraction obtained in step c) is returned at least in part to step a).

13. A process according to claim 3, wherein another part of the diesel fraction obtained in step d) is recycled to step d) in mixture with the part of the heavier liquid fraction obtained in step c).

14. A process according to claim 6, wherein the diesel fraction is recycled.

15. A process according to claim 1, wherein the hydrocarbon fraction has a sulphur content of at least 3% by weight, the resultant gasoline fraction has sulphur content of less than 10 ppm and the resultant diesel fuel has a sulphur content of less than 500 ppm.

16. A process according to claim 8, further comprising converting the asphalt with steam-oxygen to a gas containing hydrogen and carbon monoxide, and converting the aforesaid gas with steam to a further gas containing hydrogen and carbon dioxide, and passing the resultant hydrogen to at least one of steps a) and b).

17. A process according to claim 1, wherein step a) is conducted in the presence of hydrogen sulfide.

* * * * *